United States Patent [19]

Van Bilderbeek

[11] 4,133,418

[45] Jan. 9, 1979

[54] THROUGH THE FLOWLINE SELECTOR

[75] Inventor: Bernard H. Van Bilderbeek, Ventura, Calif.

[73] Assignee: Vetco, Inc., Ventura, Calif.

[21] Appl. No.: 814,104

[22] Filed: Jul. 8, 1977

[51] Int. Cl.[2] ..... B65G 11/20; E21B 41/00

[52] U.S. Cl. ..... 193/23; 137/874; 166/153

[58] Field of Search ..... 193/23, 29, 31 A; 302/28; 243/29, 30, 31; 137/874; 166/117.5, 153

[56] References Cited

U.S. PATENT DOCUMENTS

| | | | |
|---|---|---|---|
| 3,536,098 | 10/1970 | Cunningham | 302/28 |
| 3,674,123 | 7/1972 | Lewis et al. | 193/23 |
| 3,780,756 | 12/1973 | Pennington | 243/31 |

FOREIGN PATENT DOCUMENTS

| | | | |
|---|---|---|---|
| 930665 | 7/1973 | Canada | 193/23 |

*Primary Examiner*—Robert B. Reeves
*Assistant Examiner*—Jeffrey V. Nase
*Attorney, Agent, or Firm*—Bernard Kriegel; Philip Subkow

[57] ABSTRACT

A through the flowline or "TFL" tool selector has a base provided with a number of spaced flowline ports and a diverter tube shiftably mounted in a housing for selective communication with the flowline ports. The diverter tube is actuated by a reciprocable and rotatable piston and cam drive which shifts the diverter tube progressively from one flowline port to another. The piston is shiftable in a cylinder to which pressure fluid is supplied and then exhausted to effect actuation of the cam drive.

27 Claims, 7 Drawing Figures

THROUGH THE FLOWLINE SELECTOR

In the production of wells, such as oil and gas wells, it has become the practice to provide wellhead or control assemblies on templates, such as primary or secondary production templates which may be remotely located. Multiple wellheads are employed on such remote templates for controlling multiple wells or multiple completions. Such remote templates are commonly used, for example, in underwater well completions.

In order to perform various maintenance or other operations in the wells or in multiple zones of a well, it has become the practice to employ various tools which can be pumped into and from the wells through the flowlines, such practice being generally referred to as "TFL" operations and the tools being referred to as "TFL" tools.

In order to cause the tools to be directed into or from a tubing in a given well of a group or into a given tubing of a well completed with a plurality of tubings, remote tool diverters or flowline or tubing selectors have evolved. Such diverters, in general, have comprised a diverter tube which is adapted to conduct fluid through the assembly and direct the tools to a selected one of a number of flowline ports which communicate with the various well tubings or flowlines.

The flowline ports are arranged in angularly spaced relation about the axis of rotation of an indexing head which can be angularly shifted to shift the diverter tube into alignment with the selected flowline port. Accurate indexing is quite important to provide accurate alignment of the diverter tube with the selected flowline ports so that the tools will properly pass through the assembly without encountering a shoulder or ridge at the flowline port on which the tool might hang up or be damaged.

Examples of the prior art are shown in U.S. Pat. No. 3,674,123, granted July 4, 1972, for "Pig Diverter" and Canadian Pat. No. 930,665, granted July 24, 1973, for "Tool Diverter and System for Directing TFL Tools".

The present invention provides a TFL or through the flowline tool diverter assembly that is of very simple construction and which accurately positions the tool diverter tube with respect to the selected flowline port to assure a smooth, unobstructed passage for the tools through the assembly.

More particularly, the invention involves indexing the diverter tube with respect to a number of angularly spaced flowline ports by means of a cam and follower system which precisely locates the flow tube relative to the flowline ports. Operation of the cam and follower means is responsive to longitudinal motion of the indexing head which carries the diverter tube.

To effect such longitudinal motion, simple piston and cylinder means shift the indexing head in one longitudinal direction, while allowing indexing movement of the indexing head and angular movement of the end of the diverter tube which is carried by the indexing head. The other end of the diverter tube swivels in a bushing and also moves longitudinally in the bushing. Return spring means biases the piston and indexing head in the other longitudinal direction, while also allowing free indexing movement of the head. Fluid pressure in the housing also urges the head in the return direction to assure completion of the return movement. A flange on the piston overlies all but the selected flowline port.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the drawings.

Figure 1:
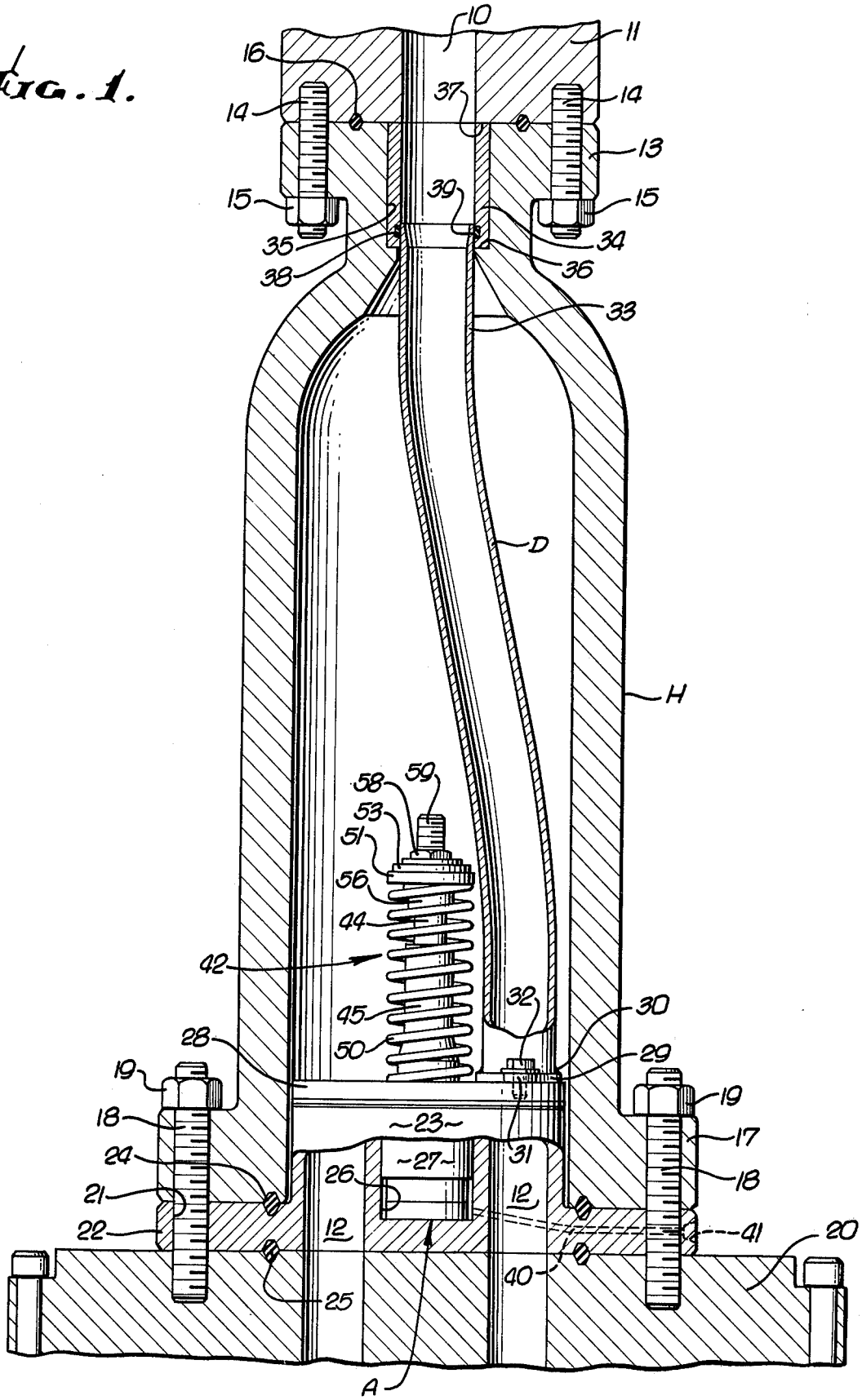
FIG. 1 is a longitudinal section, with certain parts shown in elevation, illustrating a through the flowline selector made in accordance with the invention.

As seen in the drawings, the selector for through the flowline well tools comprises a hollow pressure vessel or housing H of elongated form in which a diverter tube D is disposed for selective communication between a single passage 10 in a connector flange 11, at one end of the housing, and a selected flowline port 12, of a number of circumferentially and equally spaced flowline ports, at the other end of the housing, whereby TFL tools can be pumped through the diverter tube and through the selected flowline port 12. The housing H and the diverter tube D are longitudinally extended so that the diverter tube D is sufficiently long that the curvature or lateral offset therein does not interfere with the free movement of TFL tools therethrough.

The housing H has an end flange 13 secured as by studs 14 and nuts 15 to the connector 11. A sealing ring 16, or other suitable sealing means, is disposed in opposed grooves in the connector 11 and the flange 13 and is clamped therebetween. At its other end, the housing H has a flange 17, secured by studs 18 and nuts 19 to a connector 20. The studs 18 also extend through holes 21 in an outwardly projecting flange 22 of a base member 23 which has the flowline ports 12 therethrough. Suitable sealing rings 24 and 25 are disposed between the housing flange 17 and the base member flange 22, as well as between the flange 22 and the connector 20 to prevent leakage of fluid therebetween.

Actuator means A are provided for effecting the selective positioning of the diverter tube D to establish communication between the single port 10 in the end connector 11 and one of the plural flow ports 12 in the base member 23. Such actuator means A generally comprises a central cylinder 26 in which is reciprocably disposed an actuator piston 27. At the outer end of the actuator piston 27 is an outwardly projecting plate or flange 28, to which the inner end of the diverter tube D is connected by suitable means such as a disc member 29 welded at 30 to the diverter tube D and having opposed outstanding ears 31 fastened to the piston flange 28 by suitable fasteners 32. Thus, the diverter tube D is reciprocable with the piston 27.

Accordingly, at the outer end of the diverter tube D is an elongated cylindrical section 33 which slidably extends into a bushing 34 disposed in a bore 35 in the housing H between an inner shoulder 36 provided in the housing and an opposing shoulder 37 provided by the connector 11. In order to prevent the intrusion of particles between the opposing cylindrical surfaces provided by the diverter tube at 33 and within the bushing 34, a suitable sealing or wiping ring 38 is disposed in a groove 39 within the bushing 34, so as to wipe the cylindrical diverter tube section 33 as it reciprocates within the bushing 34. Between the cylindrical section 33 of the diverter tube D and the other end thereof the diverter tube is arched laterally, whereby the inner end thereof can be brought into alignment with the circumferentially spaced flowline ports 12 in the base member 23, as will be later described, and so as to not interfere with the freedom of motion of the usual through the flowline tools through the diverter tube.

The actuator means A are adapted to effect reciprocation of the piston 27 by the application of pressure fluid to the cylinder 26 through a suitable passageway 40 which extends through the flange 22 of the base member 23 between the cylinder 26 and the outer periphery of the flange 22, where the flange 22 is adapted at 41 to receive a suitable pressure fluid conduit. When the cylinder 26 is pressurized to shift the piston 27 outwardly with respect to the cylinder 26, the piston compresses spring means 42 adapted to store energy, whereby to effect the opposite or return movement of the piston. As will be later described, such reciprocation of the piston under the influence of pressure fluid and the spring effects indexing of the diverter tube D, and, as will also be later described, fluid pressure within the housing H supplements the force of the spring means 42 tending to cause the return stroke of the piston 27.

Figure 2:
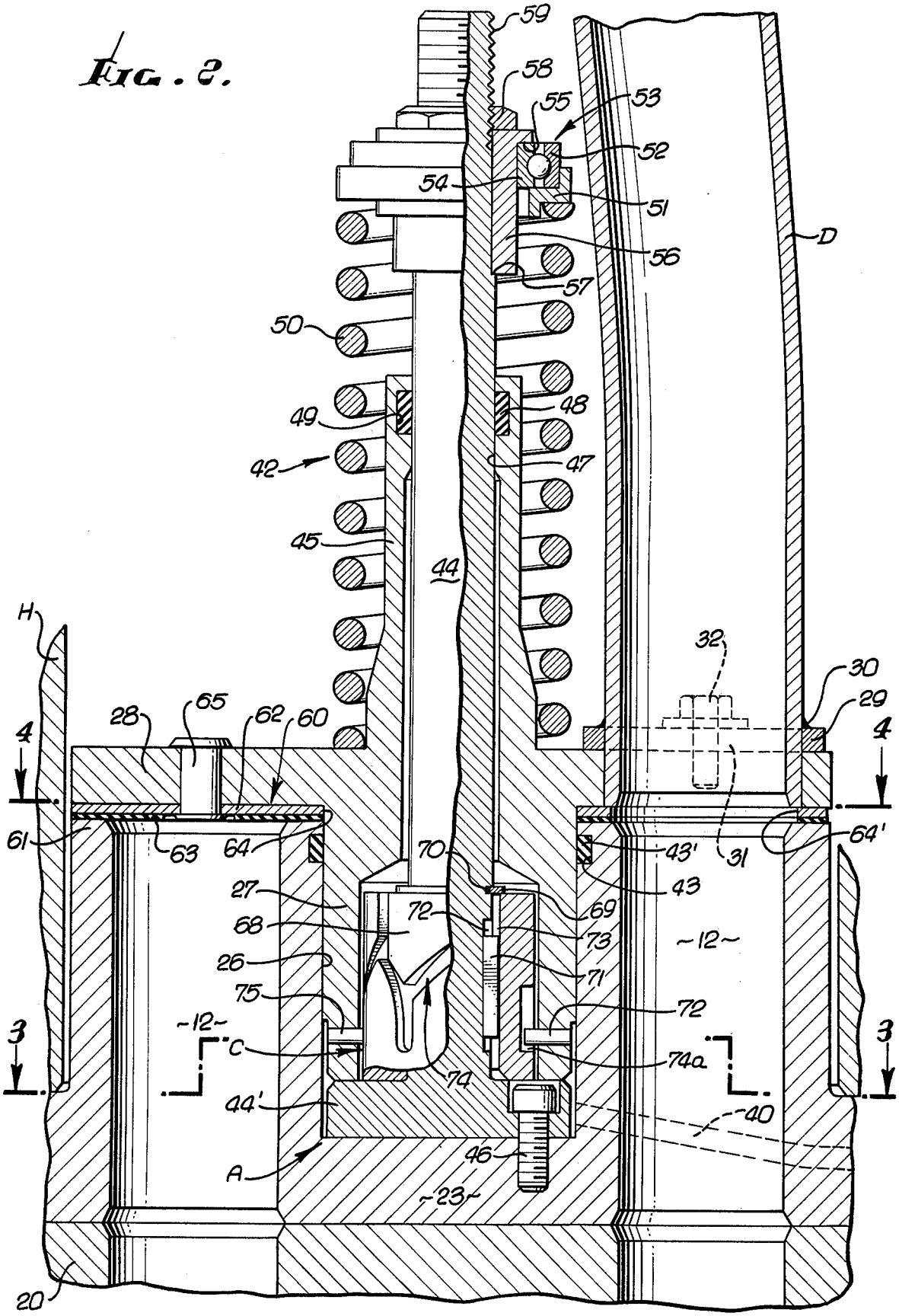
FIG. 2 is an enlarged fragmentary view in longitudinal section showing the indexing means and the operating means.

The structure of the actuator means A may be best understood by reference to FIG. 2 and the related sectional views. More particularly, the base member 23 has the cylinder 26 located coaxially thereof, and the actuator piston 27 extends into the cylinder 26 from the piston flange 28. A suitable sealing or piston ring 43' disposed in an annular groove 43 in the cylinder wall 26 provides a pressure seal to confine the pressure fluid supplied through the passage 40 to the cylinder 26.

A post 44 has an enlarged base 44' secured as by screws 46 to the inner end of the cylinder 26, the post extending coaxially through the piston 27, the piston flange 28 and an elongated tubular neck 45 which is formed or fixed to and extends coaxially outwardly from the piston flange 28. At its outer extremity the neck 45 has a cylindrical bore 47 through which the post 44 extends, and within the bore 47 a sealing ring or packing 48 received in a groove 49 within the neck 45 separates the actuator cylinder 26 from the interior of the housing H.

The return spring means 42 previously referred to, which causes return movement of the piston, comprises a coiled compression spring 50 which seats at one end against the piston flange 28 and is disposed about the neck 45. At its other end, the coiled spring 50 engages a seat 51 of annular form which receives the outer race 52 of a ball bearing assembly 53 having an inner race 54 which shoulders at 55 beneath an end flange of a bearing support sleeve 56 which is disposed on the outer end of the post 44 and secured in place, between an inner shoulder 57, on the post 44, and a nut 58 which is threaded upon the threaded outer end 59 of the post 44. Thus, while the spring 50 can act between the seat 51 and the piston flange 28 to urge the piston 27 inwardly of the cylinder 26, the entire piston and spring assembly is free to revolve relative to the post 44 by virtue of the mounting of the outer spring seat 51 in the bearing means carried by the post 44.

Figure 4:
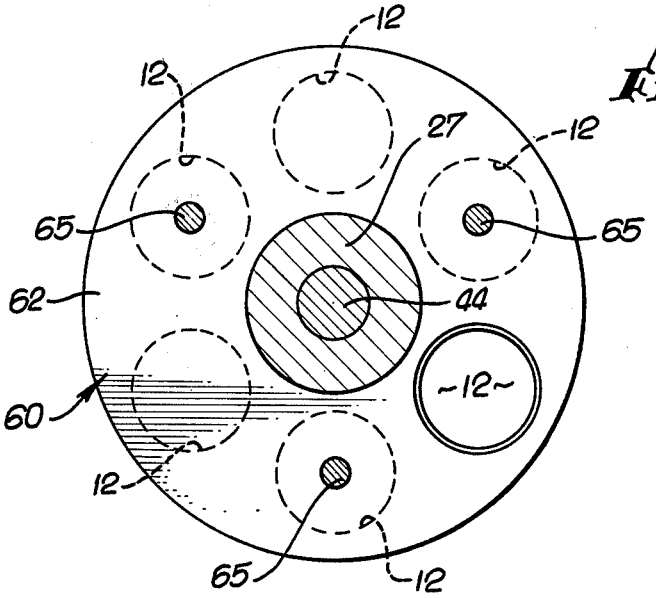
FIG. 4 is a transverse section taken on the line 4—4 of FIG. 2.
Figure 5:
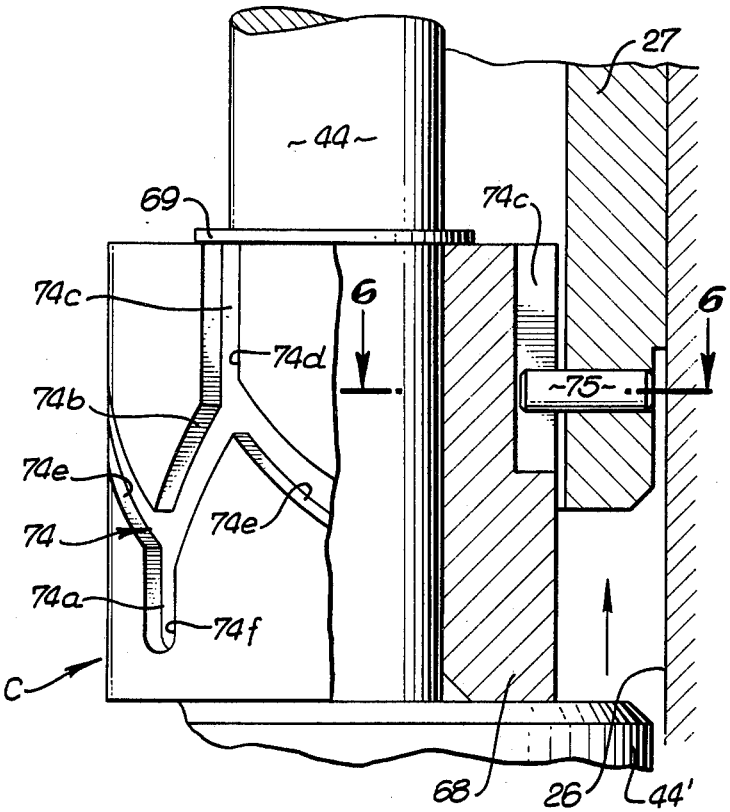
FIG. 5 is a view partly in elevation and partly in section, as taken in the line 5—5 of FIG. 3, illustrating the cam means for indexing the head.
Figure 6:
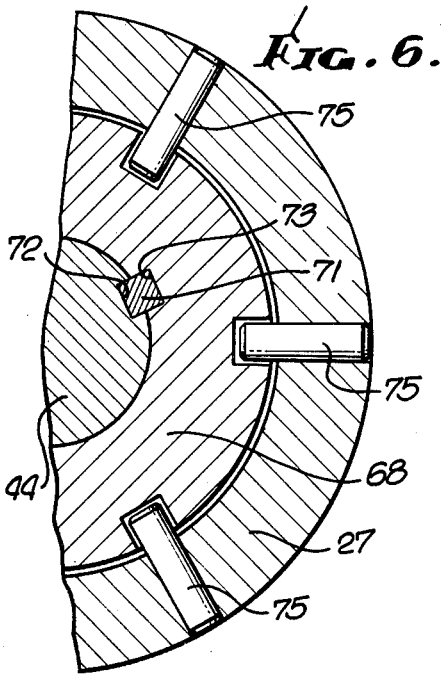
FIG. 6 is a fragmentary transverse section taken on the line 6—6 of FIG. 5.

As best seen in FIG. 2, seal plate means 60 is interposed between the piston flange 28 and the outer end surface 61 of the member 23 defining the flowline ports 12, so that when the diverter tube D is in communication with a selected one of the flowline ports, the seal plate means 60 can prevent communication of sediment between the multiple flowline ports, that is to say, the communication of fluid from the selected flowline port to the other flowline ports is inhibited. This seal means comprises a circular support disc or plate 62 having bonded thereto an elastomeric sealing disc 63. The supporting plate 62 and the sealing disc 63 have a central opening 64 through which the piston 27 projects and at a location radially spaced from the axis of the piston, the sealing disc assembly 60 has a port 64' aligned with the end of the diverter tube D, as seen in FIG. 2, for the passage of fluid and through the flowline tools between the diverter tube D and a selected flowline port 12. As seen in FIG. 2, the sealing disc assembly 60 is suitably secured to the piston flange 28 by rivets 65 or other suitable fasteners. As seen in FIG. 4, such rivets 65 are spaced angularly and circumferentially so as to lie substantially centrally of the equally spaced flowline ports 12 in the base member 23.

Cam means generally denoted as C are provided for rotating the piston 27, and thus the diverter tube D, in response to reciprocation of the actuator piston 27, to successively align the diverter tube D with a selected flowline port 12. Such cam means are best seen in FIGS. 2, 5, 6, and 7. The cam means C comprises a cam sleeve 68 which is disposed about the post 44 and held between the base 45 of the post 44 and a suitable lock ring 69 engaged in a groove 70 in the post 44 and overlying the end of the cam sleeve 68. Precise orientation of the cam sleeve 68 with respect to the base member 23 and thus with respect to the flowline ports 12 is accomplished by means of a key 71 engaged in opposing keyways 72 and 73 extending longitudinally of the post 44 and the cam sleeve 68. Formed in the cam sleeve 68 is what may be considered to be a continuous cam track generally indicated at 74 in which cam follower means in the form of radially projecting pins 75, carried by the piston 27, are engaged. The cam track is formed so that as the piston 27 reciprocates, the piston, and consequently the diverter tube D, will be caused to rotate from a location at which the diverter tube D is in communication with one of the flowline ports 12 to a location at which the diverter tube D is in communication with an adjacent flowline port 12.

Figure 3:
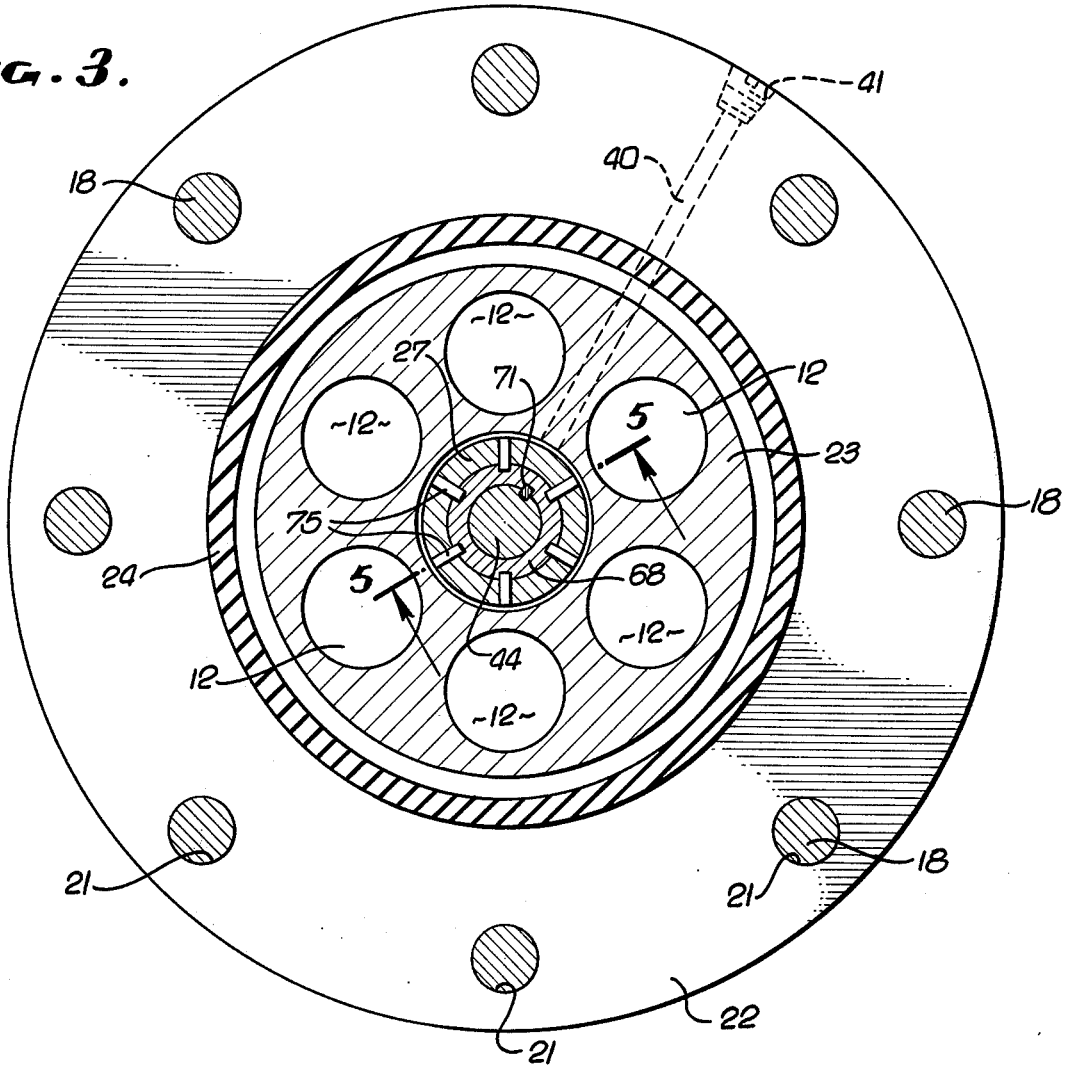
FIG. 3 is a transverse section taken on the line 3—3 of FIG. 2.
Figure 7:
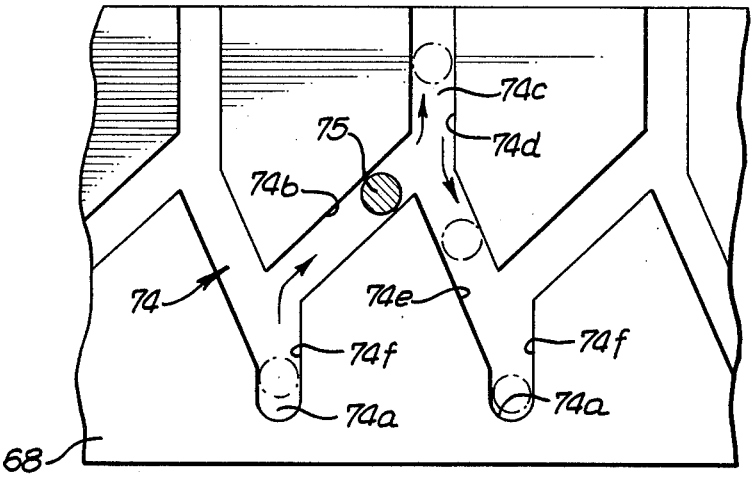
FIG. 7 is a planar projection showing the continuous cam track form and the movement of a follower through one indexing sequence.

As seen in FIG. 3 the piston 27 carries a plurality of circumferentially spaced cam follower pins 75 each of which extends into a corresponding formation of the cam slots 74. However, it will be apparent that while such a structure is prefered from the standpoint of strength, fewer cam follower pins may be employed, if desired. Referring to FIG. 7 it will be seen that a typical formation of the cam track involves a vertical track section **74*a* in which a follower pin 75 is disposed when the piston 27 is in a fully retracted condition, as seen in FIG. 2. Upon outward movement of the piston, the cam follower pins 75 will encounter an angularly extended cam wall 74b which extends circumferentially from a location at the left side of the center of vertical section 74a, as seen in FIG. 7, to a location at the left side of an upper vertical section 74c of the cam track, into which the cam follower 75 will be moved upon continued outward movement of the piston 27, during a first increment of angular motion of the piston 27, caused by coengagement of the cam follower 75 with the angular wall 74b. The vertical cam track section 74c has a vertical wall 74d which extends into confronting relation to the center of the cam track below the wall 74b, to cause the follower 75 to move into the vertical track section 74c responsive to upward movement of the piston relative to the stationary cam sleeve 68. As the piston motion is reversed and the piston is moving downwardly with respect to the cam sleeve 68, the follower 75 will encounter a cam wall 74e which extends downwardly at an angle and circumferentially of the cam sleeve from a location to the left of the center of the vertical track section 74c, downwardly to the next vertical track section 74a. The track section 74a has a vertical wall 74f confronting the follower 75, as it moves downwardly along the wall 74e, to cause the follower to move into the vertical track section 74a. Thus, the piston is caused to move through a first increment of angular motion as the piston is projected from the cylinder 26 and through a second increment of motion as the piston is moving back into the cylinder 26 on the reverse stroke. The two increments of angular motion combine to cause a total angular motion such that the diverter tube D will be caused to move from one of the flowline ports 12 to the adjacent flowline port 12. However, if it is desired that the diverter tube D be aligned with another of the angularly spaced flowline ports 12**, then it is only necessary to cycle the actuator means a sufficient number of cycles to angularly shift the diverter tube D to the selected flowline port.

In the event that the spring means 42 for some reason fails to exert sufficient force on the piston 27 to displace pressure fluid from the cylinder 26 and to cause inward movement of the piston 27, so that the piston flange 28 is fully seated, as shown in FIG. 2, it will be understood that the pressure of fluid in the sealed housing H also provides a force acting on the exposed piston area to move the piston inwardly.

From the foregoing it will now be recognized that the present invention provides a simple structure which is positively actuated to angularly shift the diverter tube, in response to the application of pressure fluid to the actuator cylinder, in such a manner that the diverter tube D is accurately indexed with respect to a selected flowline port 12 in response to such actuations.

I claim:

1. In through the flowline selector apparatus for selectively establishing communication between a single port and one of a plurality of flowlines: an elongated housing having a passage at one end, a port member at the other end of said housing and having a plurality of flowline ports spaced angularly, a diverter tube extending between said passage and said port member and rotatable and reciprocable with respect to said passage to be selectively aligned with said flowline ports, actuator means operable to reciprocate said diverter tube, and means responsive to and operable during reciprocation of said diverter tube for rotating said diverter tube to successively align said diverter tube with said flowline ports.

2. In through the flowline selector apparatus as defined in claim 1; said actuator means comprising a piston, a cylinder in which said piston is reciprocable, and passage means for admitting pressure fluid to and exhausting pressure fluid from said cylinder to move said piston in one direction and allow movement of said piston in the other direction.

3. In through the flowline selector apparatus as defined in claim 1; said actuator means comprising a piston, a cylinder in which said piston is reciprocable, and passage means for admitting pressure fluid to and exhausting pressure fluid from said cylinder to move said piston in one direction and allow movement of said piston in the other direction, and means for forcing said piston in said other direction.

4. In through the flowline selector apparatus as defined in claim 1; said actuator means comprising a piston, a cylinder in which said piston is reciprocable, and passage means for admitting pressure fluid to and exhausting pressure fluid from said cylinder to move said piston in one direction and allow movement of said piston in the other direction, and said means for rotating said diverter tube including cam means for rotating said piston in response to reciprocation of said piston.

5. In through the flowline selector apparatus as defined in claim 1; said actuator means comprising a piston, a cylinder in which said piston is reciprocable, and passage means for admitting pressure fluid to and exhausting pressure fluid from said cylinder to move said piston in one direction and allow movement of said piston in the other direction, and said means for rotating said diverter tube including cam means for rotating said piston through a first increment of angular movement upon movement of said piston in one direction and to move said piston through a second increment of angular movement upon movment of said piston in the other direction, whereby said diverter tube is moved incrementally from alignment with one of said flowline ports into alignment with another of said flowline ports.

6. In through the flowline selector apparatus as defined in claim 1; said actuator means comprising a piston, a cylinder in which said piston is reciprocable, and passage means for admitting pressure fluid to and exhausting pressure fluid from said cylinder to move said piston in one direction and allow movement of said piston in the other direction, and said means for rotating said diverter tube including cam means for rotating said piston through a first increment of angular movement upon movement of said piston in one direction and to move said piston through a second increment of angular movement upon movement of said piston in the other direction, whereby said diverter tube is moved incrementally from alignment with one of said flowline ports into alignment with another of said flowline ports, said cam means also including means for establishing alignment between said diverter tube and said flowline ports.

7. In through the flowline selector apparatus as defined in claim 1; said actuator means comprising a piston, a cylinder in which said piston is reciprocable, and passage means for admitting pressure fluid to and exhausting pressure fluid from said cylinder to move said piston in one direction and allow movement of said piston in the other direction, and said means for rotating said diverter tube including cam means for rotating said piston in response to reciprocation of said piston, said cam means also including means for establishing alignment between said diverter tube and said flowline ports.

8. In through the flowline selector apparatus as defined in claim 7; and means for forcing said piston in said other direction including return spring means.

9. In through the flowline selector apparatus as defined in claim 7; and means for forcing said piston in said other direction including return spring means, and means sealing said housing to contain fluid under pressure acting on said piston to force said piston in said other direction.

10. In through the flowline selector apparatus as defined in claim 7; and means for forcing said piston in said other direction including means sealing said housing to contain fluid under pressure acting on said piston to force said piston in said other direction.

11. In through the flowline selector apparatus as defined in claim 1; said actuator means comprising a piston, a cylinder in which said piston is reciprocable, and passage means for admitting pressure fluid to and exhausting pressure fluid from said cylinder to move said piston in one direction and allow movement of said piston in the other direction, and said means for rotating said diverter tube including cam means for rotating said piston in response to reciprocation of said piston, said cam means including continuous cam track means and cam track follower means one of which travels with said piston and the other of which is fixed to said port member.

12. In through the flowline selector apparatus as defined in claim 1; said actuator means comprising a piston, a cylinder in which said piston is reciprocable, and passage means for admitting pressure fluid to and exhausting pressure fluid from said cylinder to move said piston in one direction and allow movement of said piston in the other direction, and said means for rotating said diverter tube including cam means for rotating said piston in response to reciprocation of said piston, said cam means including continuous cam track means having a number of corresponding cam track sections equalling the number of flowline ports in said port member, and cam follower means engaged with said cam track means.

13. In through the flowline selector apparatus as defined in claim 1; said actuator means comprising a piston, a cylinder in which said piston is reciprocable, and passage means for admitting pressure fluid to and exhausting pressure fluid from said cylinder to move said piston in one direction and allow movement of said piston in the other direction, and said means for rotating said diverter tube including cam means for rotating said piston in response to reciprocation of said piston, said cam means including continuous cam track means having a number of corresponding cam track sections equalling the number of flowline ports in said port member, and cam follower means engaged with said cam track means, one of said cam track and cam follower means being carried by said piston and the other fixed to said port member.

14. In through the flowline selector apparatus as defined in claim 1; said actuator means comprising a piston, a cylinder in which said piston is reciprocable, and passage means for admitting pressure fluid to and exhausting pressure fluid from said cylinder to move said piston in one direction and allow movement of said piston in the other direction, and said means for rotating said diverter tube including cam means for rotating said piston in response to reciprocation of said piston, said cam means including continuous cam track means having a number of corresponding cam track sections equalling the number of flowline ports in said port member, and cam follower means including a follower in each of said cam track sections.

15. In through the flowline selector apparatus as defined in claim 1; said housing being a pressure vessel having sealing connector means at the said ends thereof for retaining fluid under pressure in said housing during rotation of said diverter tube.

16. In through the flowline selector apparatus: an elongated housing having connector means at one end of said housing connectable to a single ported member, a port member at the other end of said housing having a plurality of flowline ports arranged in circumferentially spaced relation, a cylinder centrally located between said flowline ports, a piston reciprocable in said cylinder, a flange projecting from said piston in overlying relation to said flowline ports, a diverter tube connected at one end to said flange in laterally spaced relation to the center of said piston for alignment with said flowline ports, said flange having a port communicating with said diverter tube, means at said one end of said housing receiving the other end of said diverter tube for rotary movement, means for admitting pressure fluid to said cylinder to urge said piston in one longitudinal direction, means for causing return longitudinal movement of said piston, and means for angularly shifting said piston and flange during longitudinal movement of said piston to rotate and align said diverter tube with a selected flowline port.

17. In through the flowline selector apparatus as defined in claim 16; said means for angularly shifting said piston and flange including cam means for rotating said piston in response to reciprocation of said piston, said cam means including means for rotating said piston through a first increment of movement upon movement of said piston in one direction and for rotating said piston through a second increment of movement upon movement of said piston in the other direction, whereby said diverter tube is moved incrementally from alignment with one of said flowline ports into alignment with another of said flowline ports.

18. In through the flowline selector apparatus as defined in claim 16; said means for angularly shifting said piston and flange including cam means for rotating said piston in response to reciprocation of said piston, said cam means including means for rotating said piston through a first increment of movement upon movement of said piston in one direction and for rotating said piston through a second increment of movement upon movement of said piston in the other direction, whereby said diverter tube is moved incrementally from alignment with one of said flowline ports into alignment with another of said flowline ports, said cam means also including means for establishing alignment between said diverter tube and said flowline ports.

19. In through the flowline selector apparatus as defined in claim 16; said piston being an annular piston, and said means for angularly shifting said piston comprising cam and cam follower means disposed within said piston and fixed to said port member and to said piston.

20. In through the flowline selector apparatus as defined in claim 16; said piston being an annular piston, and said means for angularly shifting said piston comprising cam and cam follower means disposed within said piston and fixed to said port member and to said piston, and also including a post fixed to said cam and cam follower means and extending longitudinally through said piston into said housing, a sealing neck carried by said piston and disposed about said post, a revolvable spring seat carried by said post, and a coil spring interposed between said spring seat and said piston for urging said piston in a return direction.

21. In through the flowline selector apparatus as defined in claim 16; means defining a seal engageable between said flange and said port member when said piston is in its inner position in said cylinder.

22. In through the flowline selector apparatus as defined in claim 16; means defining a seal engageable between said flange and said port member when said piston is in its inner position in said cylinder, said means forming a seal including an elastomeric disc, means mounting said disc beneath said flange, and said mounting means and said sealing disc having a single port therethrough aligned with said diverter tube and said port in said flange.

23. In through the flowline selector apparatus as defined in claim 16; said means at said one end of said housing receiving the other end of said diverter tube and said other end of said diverter tube being cylindrical in form to also allow longitudinal movement of said diverter tube, and said one end of said diverter tube being fixed to said flange.

24. In through the flowline selector apparatus as defined in claim 16; said means at said one end of said housing receiving the other end of said diverter tube and said other end of said diverter tube being cylindrical in form to also allow longitudinal movement of said diverter tube, and said one end of said diverter tube being fixed to said flange, said means for angularly shifting said piston and flange including cam means for rotating said piston and flange in response to reciprocation of said piston and flange.

25. In through the flowline selector apparatus as defined in claim 16; said means for angularly shifting said piston and flange including cam means for rotating said piston in response to reciprocation of said piston.

26. In through the flowline selector apparatus as defined in claim 16; said housing being a pressure vessel having sealing connector means at the said ends thereof for retaining fluid under pressure in said housing during rotation of said diverter tube.

27. In through the flowline selector apparatus for selectively establishing communication between a single port and one of a plurality of flowlines: a housing having a passage at one end; a port member at the other end of said housing and having a plurality of flowline ports spaced angularly; a diverter tube extending between said passage and port member and rotatable with respect to said passage to be selectively aligned with said flowline ports; and indexing means for reciprocating said diverter tube and during reciprocation of said diverter tube rotating said diverter tube to successively align said diverter tube with said flowline ports.

* * * * *